US009482483B2

(12) United States Patent
Whelan

(10) Patent No.: US 9,482,483 B2
(45) Date of Patent: Nov. 1, 2016

(54) FIREARM WITH INTEGRATED SUPPRESSOR

(71) Applicant: Daniel Joseph Whelan, Eagle, ID (US)

(72) Inventor: Daniel Joseph Whelan, Eagle, ID (US)

( * ) Notice: Subject to any disclaimer, the term of this patent is extended or adjusted under 35 U.S.C. 154(b) by 195 days.

(21) Appl. No.: 13/710,757

(22) Filed: Dec. 11, 2012

(65) Prior Publication Data

US 2014/0157640 A1 Jun. 12, 2014

(51) Int. Cl.
*F41A 21/30* (2006.01)
*F41C 23/16* (2006.01)

(52) U.S. Cl.
CPC ..... *F41A 21/30* (2013.01); *F41C 23/16* (2013.01)

(58) Field of Classification Search
CPC ..... F41A 21/30; F41A 21/32; F41A 21/325; F41A 21/34; F41A 21/36; F41A 21/38; F41A 21/488; F41A 25/26; F41C 23/16
USPC ..... 89/14.4, 14.1–14.3; 181/223; 42/75.02, 42/96
See application file for complete search history.

(56) References Cited

U.S. PATENT DOCUMENTS 880,386 A * 2/1908 Maxim ..... F41A 21/30 89/14.05
1,171,242 A * 2/1916 Prather ..... F41A 21/30 89/14.4
1,854,974 A * 4/1932 Bernat ..... F41A 21/30 181/223
2,868,078 A * 1/1959 Jarrett ..... 89/14.4
3,950,878 A * 4/1976 Musgrave ..... F41C 27/20 42/90
3,978,762 A * 9/1976 Khaidurov et al. ..... 89/14.3
4,459,895 A * 7/1984 Mazzanti ..... 89/14.3
4,716,809 A * 1/1988 A'Costa ..... 89/14.3
5,020,416 A * 6/1991 Tripp ..... F41A 21/38 89/14.3
5,343,650 A * 9/1994 Swan ..... F41C 23/16 42/117
5,652,406 A * 7/1997 Phan ..... F41A 21/36 89/14.3
6,079,311 A * 6/2000 O'Quinn et al. ..... 89/14.4
D598,066 S 8/2009 Brittingham
7,587,969 B2 9/2009 Silvers
7,856,914 B2 12/2010 Shults et al.
D639,375 S 6/2011 Oliver
8,015,908 B2 * 9/2011 Kline et al. ..... 89/14.4
8,096,222 B2 1/2012 Silvers
8,162,100 B2 4/2012 Shults et al.
9,103,618 B2 * 8/2015 Daniel ..... F41A 21/325 89/14.4
2007/0069064 A1 * 3/2007 Mott ..... 244/3.23
2010/0058922 A1 * 3/2010 Casas Salva ..... 89/14.4
2015/0090105 A1 * 4/2015 Pace ..... F41A 21/30 89/14.4
2016/0003570 A1 * 1/2016 Tonkin ..... F41A 21/30 89/14.4

* cited by examiner

*Primary Examiner* — Stephen M Johnson
*Assistant Examiner* — Benjamin Gomberg
(74) *Attorney, Agent, or Firm* — Bennet K. Langlotz; Langlotz Patent & Trademark Works, Inc.

(57) ABSTRACT

Firearms with integrated suppressors have a receiver having a forward portion defining an internal bore, a tubular body having sides defining an interior, a selected portion of the interior receiving a barrel, the barrel having a rear end removably received in the internal bore, a selected portion of the interior receiving a plurality of baffles, and wherein at least one side of the body can be disassembled into a panel to enable access to the baffles. Each of the baffles may define an aperture. The barrel may have a central bore that defines a bore axis, and the baffle apertures may be axially registered with the bore axis. At least one side of the body may have an attachment facility that removably connects an accessory to the rifle. The barrel, baffles, and body may be of monolithic or modular construction.

20 Claims, 5 Drawing Sheets

FIREARM WITH INTEGRATED SUPPRESSOR

FIELD OF THE INVENTION

The present invention relates to firearms, and more particularly to firearms with suppressors incorporated into the firearm's hand guard or rail.

BACKGROUND OF THE INVENTION

Firearms with integrated suppressors are desirable because suppressors increase the total length of the firearm and add weight to the muzzle, which impairs the weapon's balance. Usually, integration is accomplished by at least partly encompassing the barrel within the suppressor housing, instead of having the suppressor attach to and extend beyond the muzzle of the firearm.

A suppressor is a device attached to or incorporated into the barrel of a firearm that reduces the amount of noise and also usually the amount of muzzle flash generated by firing the weapon. A suppressor is usually a metal cylinder with internal mechanisms such as baffles to reduce the sound of firing by slowing the escaping propellant gas and sometimes by reducing the velocity of the bullet.

The suppressor is typically a hollow cylindrical piece of machined metal (steel, aluminum, or titanium) containing expansion chambers that attaches to the muzzle of a pistol, submachine gun or rifle. These "can"-type suppressors may be attached to and detached from various firearms. Another type is the "integral" suppressor, which consists of expansion chambers inside a tube that surrounds the barrel. The barrel is sometimes pierced with openings or "ports" that bleed off gases into the chambers for the purpose of directing gas into expansion chambers prior to exiting the muzzle, and sometimes for the purpose of slowing the velocity of the projectile under the speed of sound to prevent the supersonic flight noise of high velocity rounds.

Both types of suppressor reduce noise by allowing the rapidly expanding gases from the firing of the cartridge to be briefly diverted or trapped inside a series of hollow chambers. The trapped gas expands and cools, and its pressure and velocity decreases as it exits the suppressor. The chambers are typically divided by baffles. There are typically a number of chambers in a suppressor, depending on the intended use and design details. Baffles are usually circular metal dividers which separate the expansion chambers. Each baffle has a hole in its center to permit the passage of the bullet through the suppressor and towards the target. Baffles are typically made of stainless steel, aluminum, titanium or alloys such as Inconel, and are either machined out of solid metal, cast, molded, or stamped out of sheet metal.

Baffles may be separated by spacers, which keep them aligned at a specified distance apart inside the suppressor. Many baffles are manufactured as a single assembly with their spacers, and several suppressor designs have all the baffles attached together with spacers as a one-piece "monocore" baffle stack. Modern baffles are usually carefully shaped to divert the propellant gases effectively into the chambers. This shaping can be a slanted flat surface, canted at an angle to the bore, or a conical or otherwise curved surface. One popular technique is to have alternating angled surfaces through the stack of baffles.

Traditional integrated systems consist of the firearm's barrel, the suppressor's baffles, the suppressor's body or housing tube that encloses the baffles, and an accessory mounting rail or non-railed hand guard surrounding the suppressor housing. However, there is no handguard surrounding most existing integrated pistol designs. This type of suppressor is part of the firearm, and maintenance of the suppressor requires at least partial disassembly of the firearm or hand guard, or removing the suppressor from the firearm, which may be disadvantageous for many users.

Therefore, a need exists for a new and improved firearm with integrated suppressor that incorporates the accessory mounting rail or non-railed hand guard itself as the suppressor's housing. In this regard, the various embodiments of the present invention substantially fulfill at least some of these needs. In this respect, the firearm with integrated suppressor according to the present invention substantially departs from the conventional concepts and designs of the prior art, and in doing so provides an apparatus primarily developed for the purpose of facilitating suppressor cleaning via removable side panels that provide access to the suppressor's internals without requiring disassembly of the firearm.

SUMMARY OF THE INVENTION

The present invention provides an improved firearm with integrated suppressor, and overcomes the above-mentioned disadvantages and drawbacks of the prior art. As such, the general purpose of the present invention, which will be described subsequently in greater detail, is to provide an improved firearm with integrated suppressor that has all the advantages of the prior art mentioned above.

To attain this, the preferred embodiment of the present invention essentially comprises a rifle with a receiver having a forward portion defining an internal bore, a tubular body having sides defining an interior, a selected portion of the interior receiving a barrel, the barrel having a rear end removably received in the internal bore, a selected portion of the interior receiving a plurality of baffles, and wherein at least one side of the body can be disassembled into a panel to enable access to the baffles. Each of the baffles may define an aperture. The barrel may have a central bore that defines a bore axis, and the baffle apertures may be axially registered with the bore axis. At least one side of the body may have an attachment facility that removably connects an accessory to the rifle. The barrel, baffles, and body may be of monolithic or modular construction. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
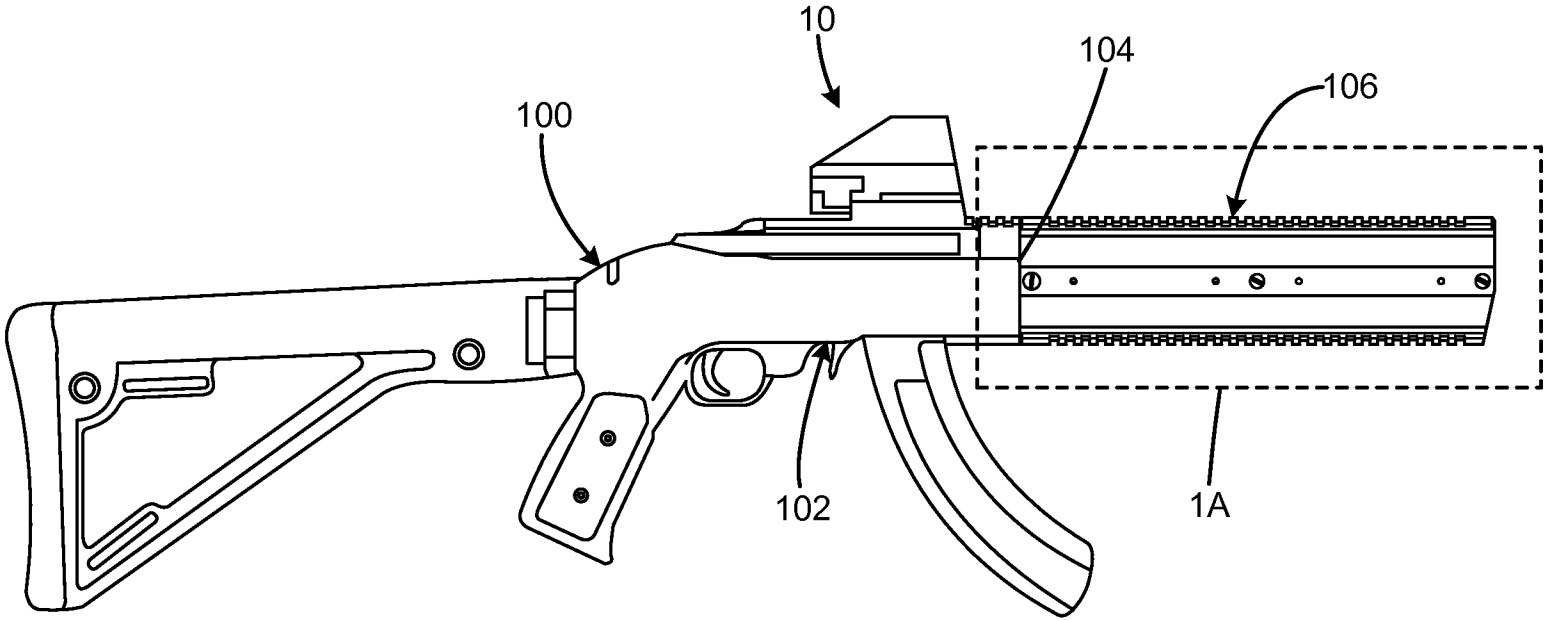
FIG. 1 is a right side view of a current embodiment of the firearm with integrated suppressor constructed in accordance with the principles of the present invention, where the firearm is a rifle and the suppressor is of monolithic construction.

A preferred embodiment of the firearm with integrated suppressor of the present invention is shown and generally designated by the reference numeral 10.

Figure 1A:
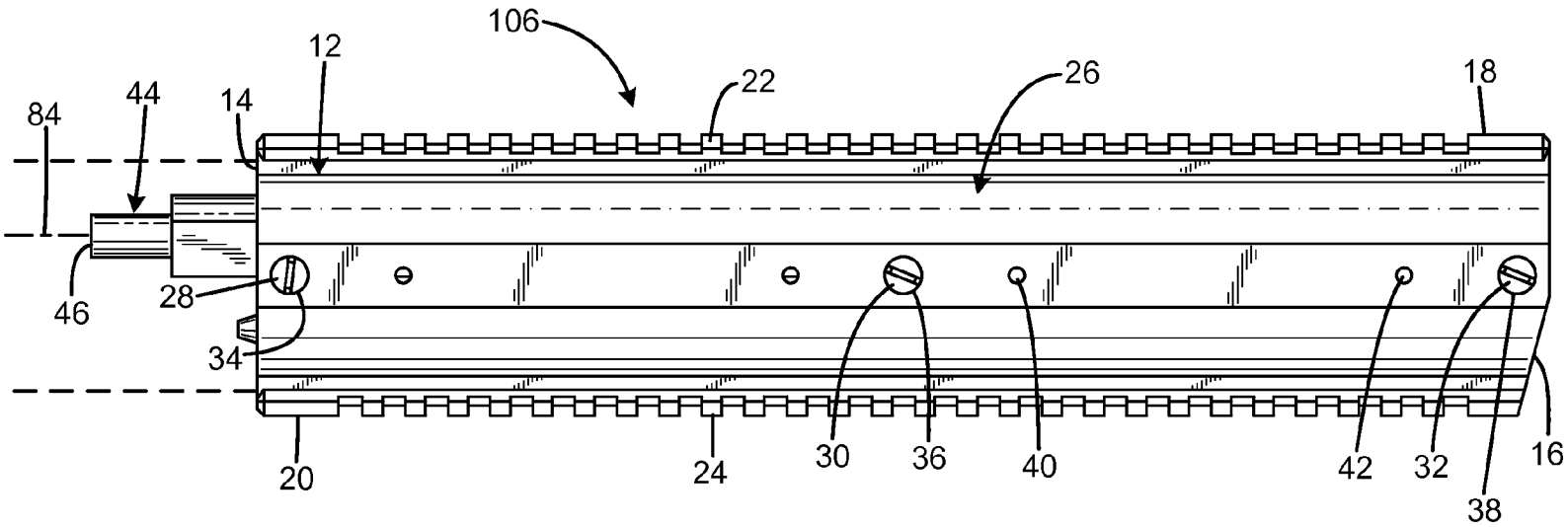
FIG. 1A is an enlarged view of the dashed line rectangular area marked 1A of FIG. 1.

FIGS. 1 and 1A illustrate improved firearm with integrated suppressor of the present invention. More particularly, the firearm with integrated suppressor 10 is a rifle 100. The rifle has a receiver 102 with a front 104. The integrated suppressor 106 has a barrel 44 with a central bore 82 (shown in FIG. 2) that defines a bore axis 84. The rear of the barrel is inserted into an internal bore (not visible) within the front of the receiver when the rear 14 of the integrated suppressor is connected to the front 104 of the receiver.

The integrated suppressor 106 has a housing 12 with a rear 14, front 16, top 18, and bottom 20. In the current embodiment, the top forms a top rail 22, and the bottom forms a bottom rail 24. Alternative types of attachment facilities such as screw holes or a dovetail for a front sight could also be present. The top and bottom rails provide secure mounting locations for accessories such as optics, laser sights, lights, and cameras. The sides of the suppressor are closed off by a left side panel (not visible) and a right side panel 26. The right side panel is attached to the housing by a rear screw 28, middle screw 30, and front screw 32 inserted through rear screw hole 34, middle screw hole 36, and front screw 38. The right side panel has a rear screw hole 40 and a front screw hole 42 that enable accessory mounting rail sections to be attached. The screw holes do not penetrate all the way through to the inside of the suppressor. The left side panel has the same features as the left side panel 280 shown in FIG. 3.

Figure 2:
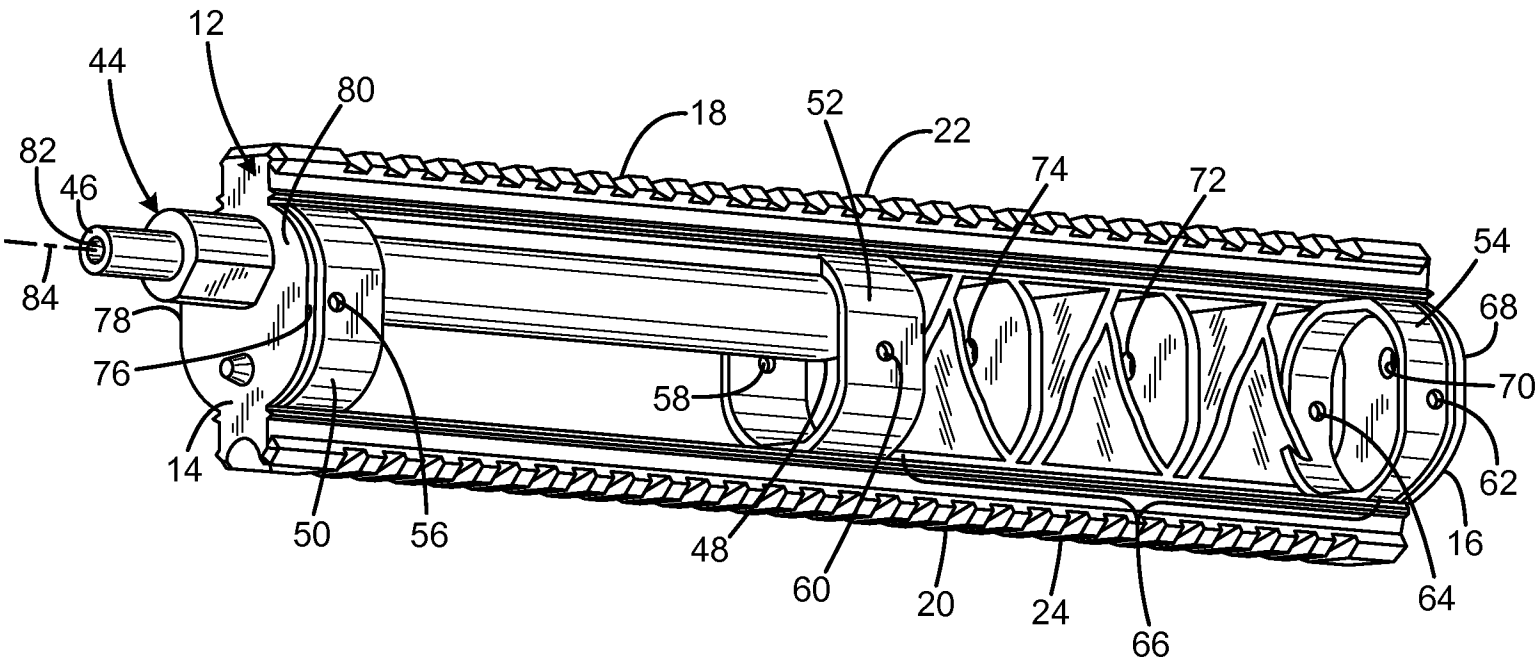
FIG. 2 is a rear perspective view of the integrated suppressor of FIG. 1 removed from the firearm with the left and right side panels removed.

FIG. 2 illustrates the housing 12 of the present invention. More particularly, the housing has been removed from the rifle 100, and the left side panel and right side panel 26 have been removed to expose the internals of the suppressor 106. In the current embodiment, the housing and the internals are of monolithic construction with the barrel being built as an integral part of the suppressor. All of the features are laterally accessible by machine tools, and the barrel can be milled out of the same piece as the housing.

The rear 46 of the barrel 44 protrudes rearwardly from the rear cap 80 at the rear 14 of the housing 12. The barrel extends between a rear support ring 50 and a middle support ring 52 in the housing, with the front 48 of the barrel terminating at the middle support ring. A series of baffles 66 extends from the middle support ring to the front support ring 54. Each baffle has an aperture axially aligned with the bore axis 84 to permit passage of a projectile through the baffles (apertures 72 and 74 are visible). A front cap 68 located at the front 16 of the housing also has an aperture 70 axially aligned with the bore axis that permits a projectile to exit the firearm 100.

The support rings 50, 52, 54 each have a threaded screw hole on either side (screw holes 56, 58, 60, 62, and 64 are visible). The screw holes receive the screws (screws 28, 30, and 32 are shown in FIG. 1) that removably attach the left side panel and the right side panel 26 to the housing 12.

Conventional suppressors require removal of the baffles from the suppressor housing in order to remove carbon buildup. However, the carbon accumulates on both the baffles and the interior of the housing, which makes the baffles extremely difficult to remove from the housing. In contrast, the baffles of the current invention are readily accessible by the removable left and right side panels, and the baffles do not have to be removed from the housing for cleaning.

Figure 3:
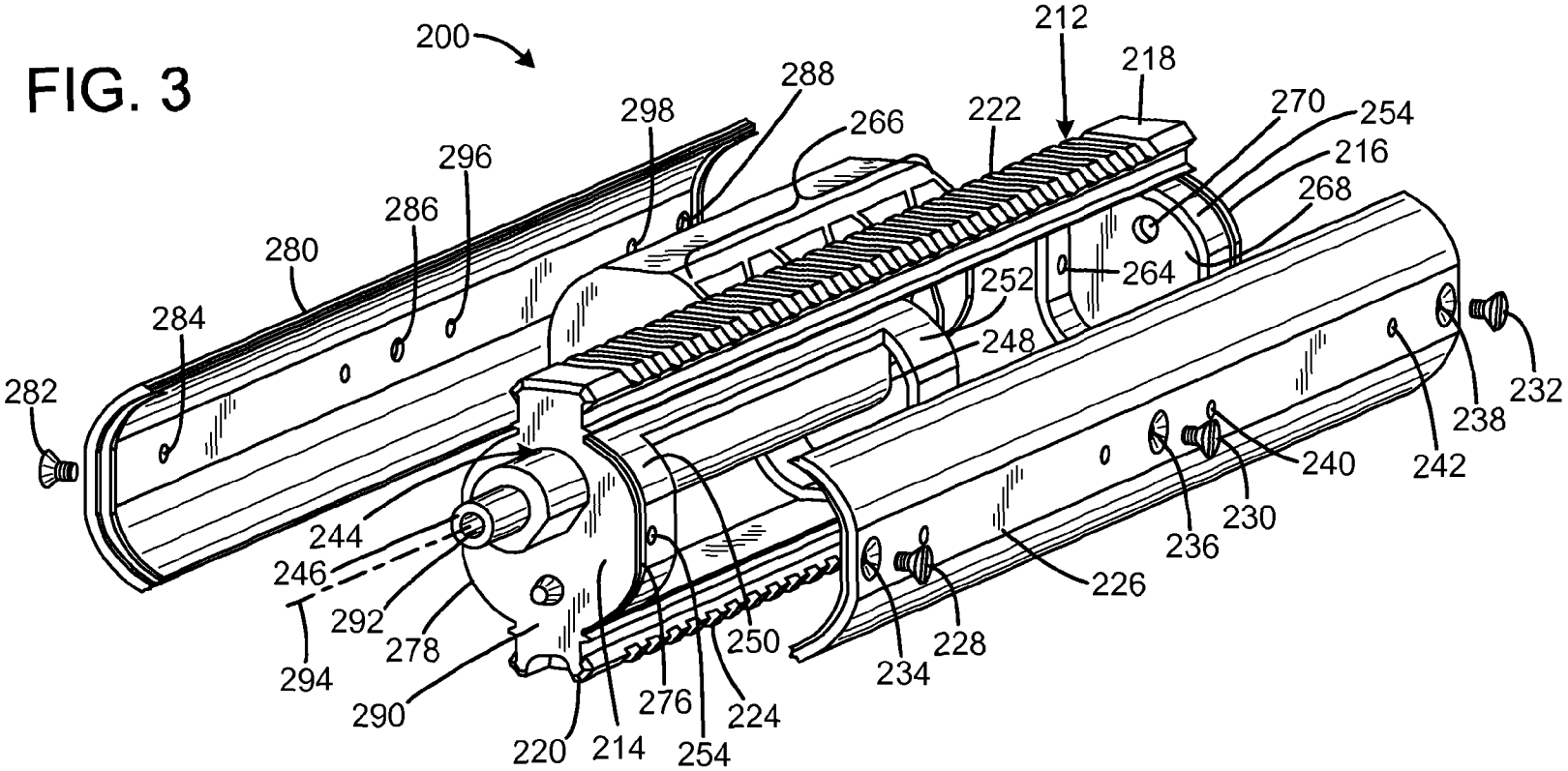
FIG. 3 is a rear perspective exploded view of a first alternative embodiment of the integrated suppressor of the present invention, where the suppressor is of modular construction.

FIG. 3 illustrates a first alternative embodiment of the improved integrated suppressor of the present invention. More particularly, the suppressor 200 is shown detached from a firearm, such as the rifle 100 of FIG. 1. In the current embodiment, the housing 212 and the suppressor internals are of modular construction.

The integrated suppressor 200 has a barrel 244 with a central bore 292 that defines a bore axis 294. The rear 246 of the barrel is inserted into an internal bore within the front of the receiver when the rear 214 of the integrated suppressor is connected to the front of a firearm's receiver.

The integrated suppressor 200 has a housing 212 with a rear 214, front 216, top 218, bottom 220, right side 276, and left side 278. The top forms a top rail 222, and the bottom forms a bottom rail 224. The sides of the suppressor are closed off by a left side panel 280 and a right side panel 226. The right side panel is attached to the housing by a rear screw 228, middle screw 230, and front screw 232 inserted through rear screw hole 234, middle screw hole 236, and front screw 238. The right side panel has a rear port 40 and a front port 42 that vent propellant gases from the baffles. The left side panel has a rear screw 282, middle screw (not visible), and front screw (not visible) inserted through rear screw hole 284, middle screw hole 286, and front screw hole 288. The left side panel has a rear screw hole 296 and a front screw hole 298 that enable accessory mounting rail sections to be attached. The screw holes do not penetrate all the way through to the inside of the suppressor.

The barrel extends between a rear support ring 250 and a middle support ring 252 in the housing 212, with the front 248 of the barrel terminating at the middle support ring. A series of baffles 266 in a module are inserted into the housing between the middle support ring and the front support ring 254. Each baffle has an aperture axially aligned with the bore axis 294 to permit passage of a projectile through the baffles (the apertures are not visible). A front cap 268 located at the front 216 of the housing also has an aperture 270 axially aligned with the bore axis that permits a projectile to exit the firearm.

The support rings 250, 252, 254 each have a threaded screw hole on either side (screw holes 256 and 264 are visible). The screw holes receive the screws (screws 228, 230, 232, and 282 are shown) that removably attach the left side panel 280 and the right side panel 226 to the housing 212. In this embodiment, not only are the baffles readily accessible by the removable panels, but the baffle module can also be removed from the housing if necessary to facilitate cleaning.

Figure 4:
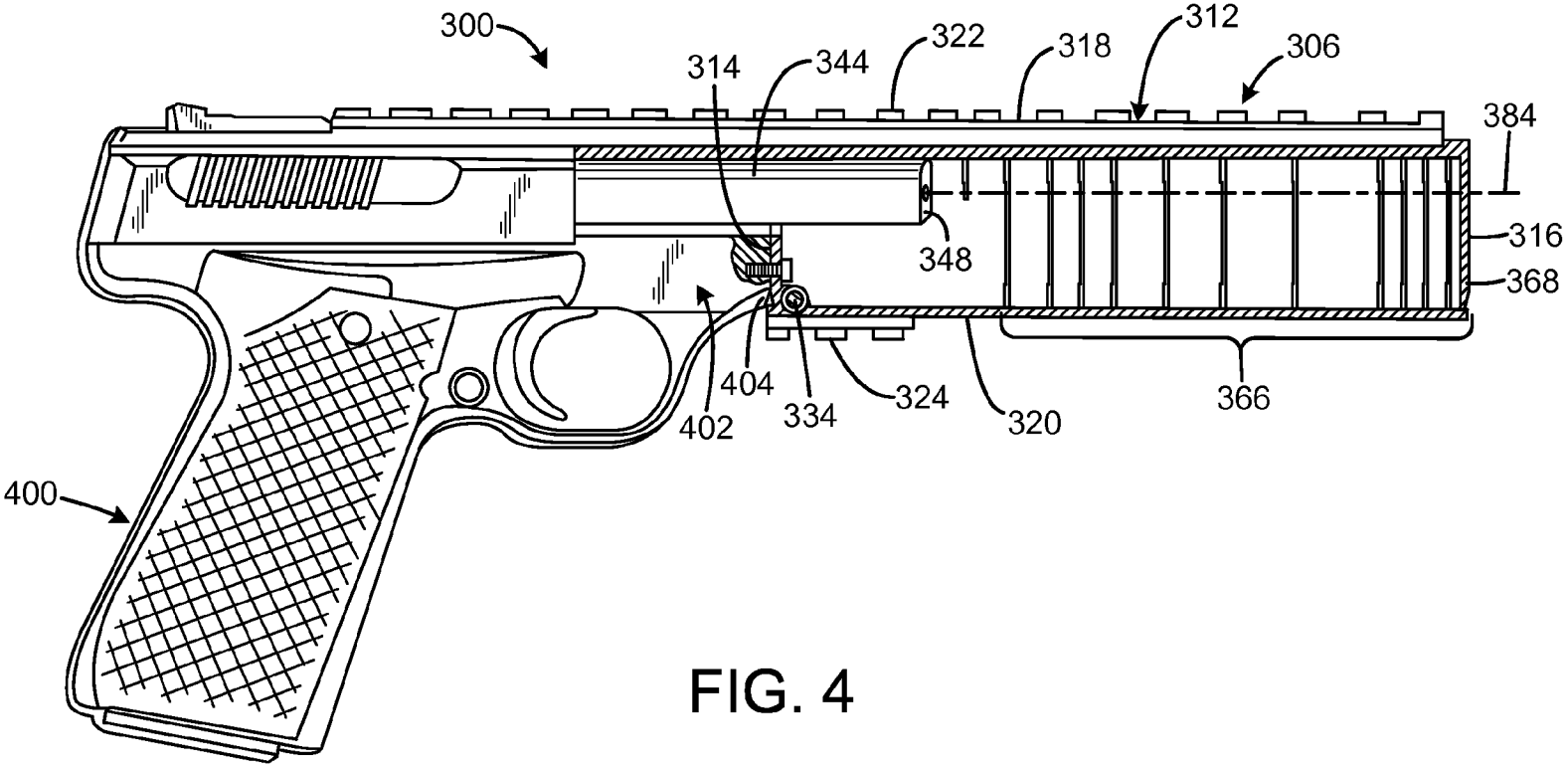
FIG. 4 is a right side view of a second alternative embodiment of the firearm with integrated suppressor, where the firearm is a pistol and the suppressor is of monolithic construction.

FIG. 4 illustrates a second alternative embodiment of the improved firearm with integrated suppressor of the present invention. More particularly, the firearm with integrated suppressor 300 is a pistol 400. The pistol has a frame 402 with a front 404. The integrated suppressor 306 has a barrel 344 with a central bore that defines a bore axis 384. The rear of the barrel is inserted into an internal bore (not visible) within the front of the frame when the rear 314 of the integrated suppressor is connected to the front 404 of the receiver. In this embodiment, which attaches to a Browning® Buck Mark® .22LR pistol, the barrel portion of the suppressor attaches to the pistol in the same manner as the manufacturer's original barrel does. In the case of other pistols, the barrel could attach to the firearm in a number of ways, including being manufactured integrally to the frame, being screwed into a barrel support, or being slid into a groove and secured with screws. The integrated suppressor is shown with the left and right side panels removed. In the current embodiment, the housing and internals are of monolithic construction.

The integrated suppressor 306 has a housing 312 with a rear 314, front 316, top 318, and bottom 320. The top forms a top rail 322, and the bottom forms a bottom rail 324. The sides of the suppressor are closed off by a left side panel and a right side panel (not shown). The right side panel is attached to the housing by a screw (not shown) received by screw hole 334 in the housing. The left side panel is similarly attached to the housing.

The barrel extends forwardly in the housing 312, with the front 348 of the barrel terminating in front of the front 404 of the frame 402. A series of baffles 366 extends from the front of the barrel to the front cap 368 at the front 316 of the housing. In the current embodiment, the "front cap" is not a separate part, but is simply the last baffle of the monolithic baffle stack serving as a front end cap. Each baffle has an aperture axially aligned with the bore axis 384 to permit passage of a projectile through the baffles (the apertures are not visible). The barrel's bore axis is not centered through the suppressor, so the apertures in the baffles are also not centered through the suppressor. The front cap also has an aperture (not visible) axially aligned with the bore axis that permits a projectile to exit the firearm 400.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of the firearm with integrated suppressor has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the removable side panels could be smooth, textured handguards, accessory mounting rails, or incorporate rail mounting points. Also, the monolithic integrated suppressor for a pistol may have internals of modular construction instead of the monolithic construction described. In addition, the baffles may be mounted in slots and be individually removable instead of being of monolithic construction as either part of a module or the housing.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle comprising:

a receiver having a forward portion defining an internal bore;

a tubular body having opposed forward and rear ends defining an interior;

the forward and rear ends each having an upper portion and a lower portion;

a top strap element connected between the upper portions of each of the forward and rear ends;

a bottom strap element connected between the lower portions of each of the forward and rear ends;

the forward end of the body having a front contoured surface portion integral with the body and extending from the top strap to the bottom strap;

the rear end of the body having a rear contoured surface portion integral with the body and extending from the top strap to the bottom strap;

a pair of removable side panels;

each side panel having a forward edge abutting the forward end of the body and sealably overlaying the front contoured surface portion, a rear edge abutting the rear end of the body and sealably overlaying the rear contoured surface portion, an upper edge abutting the top strap element, and a lower edge abutting the bottom strap element;

a first selected portion of the interior receiving a barrel;

the barrel having a rear end removably received in the internal bore;

a second selected portion of the interior receiving a plurality of baffles; and wherein each side panel is separable from the baffles.

2. The rifle of claim 1 wherein each of the baffles defines an aperture.

3. The rifle of claim 2 wherein the barrel has a central bore that defines a bore axis, and wherein the baffle apertures are axially registered with the bore axis.

4. The rifle of claim 1 wherein the body has an attachment facility that removably connects an accessory to the rifle.

5. The rifle of claim 1 wherein the barrel, baffles, and body are of monolithic construction.

6. The rifle of claim 1 wherein the barrel, baffles, and body are of modular construction.

7. A pistol comprising:

a frame having a forward portion defining an internal bore;

a tubular body having opposed forward and rear ends defining an interior;

the forward and rear ends each having an upper portion and a lower portion;

a top strap element connected between the upper portions of each of the forward and rear ends;

a bottom strap element connected between the lower portions of each of the forward and rear ends;

the forward end of the body having a front contoured surface portion integral with the body and extending from the top strap to the bottom strap;

the rear end of the body having a rear contoured surface portion integral with the body and extending from the top strap to the bottom strap;

a pair of removable side panels;

each side panel having a forward edge abutting the forward end of the body and sealably overlaying the front contoured surface portion, a rear edge abutting the rear end of the body and sealably overlaying the rear contoured surface portion, an upper edge abutting the top strap element, and a lower edge abutting the bottom strap element;

a first selected portion of the interior receiving a barrel;

the barrel having a rear end removably received in the internal bore;

a second selected portion of the interior receiving a plurality of baffles; and wherein each side panel is separable from the baffles.

8. The pistol of claim 7 wherein each of the baffles defines an aperture.

9. The pistol of claim 8 wherein the barrel has a central bore that defines a bore axis, and wherein the baffle apertures are axially registered with the bore axis.

10. The pistol of claim 7 wherein the body has an attachment facility that removably connects an accessory to the pistol.

11. The pistol of claim 7 wherein the barrel, baffles, and body are of monolithic construction.

12. The pistol of claim 7 wherein the barrel, baffles, and body are of modular construction.

13. A sound suppression system comprising:

a tubular body having opposed forward and rear ends defining an interior;

the forward and rear ends each having an upper portion and a lower portion;

a top strap element connected between the upper portions of each of the forward and rear ends;

a bottom strap element connected between the lower portions of each of the forward and rear ends, the forward end of the body having a front contoured surface portion integral with the body and extending from the top strap to the bottom strap;

the rear end of the body having a rear contoured surface portion integral with the body and extending from the top strap to the bottom strap;

a pair of removable side panels;

each side panel having a forward edge abutting the forward end of the body and sealably overlaying the front contoured surface portion, a rear edge abutting the rear end of the body and sealably overlaying the rear contoured surface portion, an upper edge abutting the top strap element, and a lower edge abutting the bottom strap element;

the interior receiving a plurality of baffles; and the side panels being separable from the baffles.

14. The sound suppression system of claim 13 wherein each of the baffles defines an aperture.

15. The sound suppression system of claim 13 wherein the baffles and body are of monolithic construction.

16. The sound suppression system of claim 13 wherein the baffles and body are of modular construction.

17. The sound suppression system of claim 13 wherein at least one of the top strap and the bottom strap includes a picatinny rail.

18. The sound suppression system of claim 13 wherein the pair of removable side panels are laterally opposing.

19. The sound suppression system of claim 13 wherein the side panels have a smooth interior surface abutting the baffles.

20. The sound suppression system of claim 13 including a plurality of fasteners removably securing the side panels to the body.

* * * * *